US009618252B2

(12) United States Patent
Andrews

(10) Patent No.: US 9,618,252 B2
(45) Date of Patent: Apr. 11, 2017

(54) COOLER INSERT

(71) Applicant: Bruce C. Andrews, Rock Hill, SC (US)

(72) Inventor: Bruce C. Andrews, Rock Hill, SC (US)

( * ) Notice: Subject to any disclaimer, the term of this patent is extended or adjusted under 35 U.S.C. 154(b) by 163 days.

(21) Appl. No.: 14/592,903

(22) Filed: Jan. 9, 2015

(65) Prior Publication Data

US 2015/0192340 A1 Jul. 9, 2015

Related U.S. Application Data

(60) Provisional application No. 61/964,547, filed on Jan. 9, 2014.

(51) Int. Cl.
*F25D 3/08* (2006.01)
*F25D 31/00* (2006.01)

(52) U.S. Cl.
CPC ..... *F25D 3/08* (2013.01); *F25D 31/007* (2013.01); *F25D 2303/082* (2013.01); *F25D 2303/0841* (2013.01); *F25D 2303/08222* (2013.01)

(58) Field of Classification Search
CPC .... F25D 3/08; F25D 31/007; F25D 2303/082; F25D 2303/0841; F25D 2331/805; F25D 2303/08222; F25D 2331/809; B65D 77/0486; B65D 77/0493; B65D 81/3883; B65D 81/3205; B65D 81/3813; B65D 81/3818; B65D 81/3825; B65D 2577/042; B65D 21/0202; B65D 71/70
See application file for complete search history.

(56) References Cited

U.S. PATENT DOCUMENTS

| | | | | |
|---|---|---|---|---|
| 4,554,798 | A | 11/1985 | D'Amour et al. | |
| 5,022,235 | A | 6/1991 | Grissom | |
| 5,024,067 | A | 6/1991 | Maier, II | |
| 5,095,718 | A | 3/1992 | Ormond et al. | |
| 5,522,239 | A | 6/1996 | Schwartz et al. | |
| 5,653,124 | A | 8/1997 | Weber | |
| 5,758,513 | A | 6/1998 | Smith | |
| 5,806,338 | A | 9/1998 | Schwartz et al. | |
| 5,901,571 | A | 5/1999 | Whaley | |
| 6,067,813 | A | 5/2000 | Smith | |
| 6,216,487 | B1 | 4/2001 | Gano, III | |
| 6,446,461 | B1 | 9/2002 | Williams, Jr. | |
| 6,990,831 | B2 | 1/2006 | Fiene | |
| 7,010,935 | B2 | 3/2006 | Citrynell et al. | |
| 7,121,112 | B2 | 10/2006 | Robertson | |
| 7,240,514 | B2 | 7/2007 | Gary | |
| 8,230,697 | B2 | 7/2012 | Lavallee | |
| 2005/0109776 | A1* | 5/2005 | Camp | A45C 11/20 220/23.86 |

(Continued)

*Primary Examiner* — Elizabeth Martin
(74) *Attorney, Agent, or Firm* — Memminger E. Wiggins

(57) ABSTRACT

A cooler insert comprising a hexahedrical container having an exterior surface and a hollow interior forming a fluid-tight reservoir containing a refrigerant material. The hexahedrical container includes a plurality of deep beverage receptacles on the top side of its exterior surface and a plurality of shallow beverage receptacles on the bottom side of its exterior surface. The design and configuration of the beverage receptacles enables a single cooler insert to be used alone or multiple cooler inserts to be used in a stacked configuration.

17 Claims, 3 Drawing Sheets

(56) References Cited

U.S. PATENT DOCUMENTS

| | | | | |
|---|---|---|---|---|
| 2013/0180683 | A1* | 7/2013 | Khan | F28D 20/02 165/46 |
| 2013/0233011 | A1* | 9/2013 | Wolf | F25D 3/08 62/457.5 |
| 2014/0137575 | A1* | 5/2014 | Guerrero | A23B 5/04 62/64 |

* cited by examiner

COOLER INSERT

RELATED APPLICATIONS

Not Applicable.

STATEMENT AS TO RIGHTS TO INVENTIONS MADE UNDER FEDERALLY SPONSORED RESEARCH AND DEVELOPMENT

Not Applicable.

PARTIES TO A JOINT RESEARCH AGREEMENT

Not Applicable.

SEQUENCE LISTING

Not Applicable.

FIELD OF THE INVENTION

The present invention relates generally to beverage coolers and to re-freezable cooler inserts which are designed and configured to receive, transport, and cool beverage containers.

BACKGROUND OF THE INVENTION

There is multitude of different types of coolers and cooler inserts for keeping food and beverages cool, or warm, until such items are consumed. These coolers and inserts come in a wide variety of shapes and sizes. Some coolers have hard outer and inner shells, some have soft outer and inner shells, and some are simply have a nylon fabric serving as the covering for the cooler itself or for individual packages of refrigerant material. Similarly, cooler inserts come in variety of shapes and sizes. Some cooler inserts have a hard outer shell, some cooler inserts package their refrigerant material inside a soft flexible plastic covering, and some require the user to fill the cooler insert with a refrigerant material of some kind, generally water, before use.

In order to maintain the temperature within the beverage/food compartment of a cooler, some type of insulating material is disposed between the outer and the inner shells of the cooler. One of the most common insulating materials used in these types of coolers is a high density foam material which is generally adequate at maintaining a cool or warm temperature within the cooler. Some of the most common means to cool the interior of most generic coolers include blocks of ices, cubed ice, crushed ice, cold water, and cooled or frozen individual packages of refrigerant. These and other methods utilized to cool the interior of a cooler, as well as the use of some cooler inserts, often present undesirable results.

The use of ice blocks or ice cubes as a coolant, as well as the use of hard-shelled cooler inserts, limits the number and manner in which beverages or food items can be arranged within the cooler resulting in an inefficient use of the cooler's interior space. Although crushed ice can be manipulated to some extent within a cooler's interior, there remains space between the crushed ice particles which cannot be used for more efficient packing of beverages or food. Although the use of cooler inserts with refrigerant packaged in a soft plastic covering provides some limited flexibility with regard to the interior space of a cooler, the positioning of these cooler inserts may shift during transportation of the cooler. Regardless of which form of ice is used as a coolant, as the ice melts undesired consequences can occur. As ice melts, the position and arrangement of the beverages or food items within the cooler will shift in the resulting ice water. Retrieving beverages by hand from melted ice water can be unpleasant due to the cold temperature of the water as well as its wetness if a person prefers or needs to maintain dry hands. The possibility of contaminating food items and beverages also exits with melted ice water should the water be able to get inside the packaging of such items. If using ice or cold water as a refrigerant, it can become contaminated by dirt or other debris which in turn may contaminate the beverages or food items within the cooler. Also, depending on the nature of the contaminated ice, its disposal may have an undesired environmental impact or health risk. Additionally, the contaminated ice or cold water will need to be replaced which may or may not be possible if a source for more ice or cold water is not available. Furthermore, often when ice is used as a coolant it will be necessary to purchase new ice once the ice has melted and discarded. The use of ice or cold water as a refrigerant will also result in the necessity of the cooler needing to be thoroughly cleaned after each use. The aforementioned issues related to the use of ice and cold water as a refrigerant also exits with the refrigerants used for cooler inserts. For example, in the event the integrity of the cooler insert exterior become damaged and allow its refrigerant to leak into a cooler's interior, the items within the cooler may become spoiled or contaminated, disposal of the refrigerant may contaminate the environment and the person using the cooler, and a thorough cleaning of the cooler becomes necessary.

Accordingly, there remains room for improvement and variation within the art.

SUMMARY OF THE INVENTION

The invention therefore provides a cooler insert that provides for the effective and safe cooling of beverage containers and food items as well as the efficient use of a cooler's interior space.

It is at least one aspect of the present embodiments to provide a cooler insert comprising a hexahedrical container, a plurality of deep beverage receptacles, a plurality of shallow beverage receptacles, a hollow interior, and a refrigerant material. The hexahedrical container has an exterior surface which includes a top side and a bottom side. The plurality of deep beverage receptacles are arranged in a parallel configuration and extend from the top side of the exterior surface. Additionally, the deep beverage receptacles have a cylindrically shaped side that emanates downward to a bottom. The plurality of shallow beverage receptacles extend from the bottom side of the exterior surface and are co-axially aligned with the deep beverage receptacles located on the top side of the exterior surface. Additionally, the shallow beverage receptacles have a cylindrically shaped side emanating upward to a top. The hollow interior of the present invention is surrounded by the exterior surface of the hexahedrical container and the plurality of cylindrically shaped sides of both the deep beverage receptacles and the shallow beverage receptacles. The refrigerant material is disposed within the hollow interior of the hexahedrical container. Furthermore, the hollow interior is designed and configured to provide a fluid-tight reservoir to hold the refrigerant material.

It is at least one aspect of the present embodiments to provide a cooler insert in which each of the deep beverage receptacles on the top side of the hexahedrical container are designed and configured to enclose a substantial portion of a beverage container, wherein the beverage container has a top portion and a body portion.

It is at least one aspect of the present embodiments to provide a cooler insert in which each of the shallow beverage receptacles have a depth sufficient to at least partially enclose the top portion of a beverage container when a first cooler insert is stacked on top of a second cooler containing one or more beverage containers.

It is still a further aspect of at least one of the present embodiments to provide a cooler insert in which the refrigerant material includes, but is not limited to a gel refrigerant.

It is at least one aspect of the present embodiments to provide a cooler insert in which the exterior surface is manufactured from a heat conductive polymer, such as but not limited to, polyethylene, polypropylene, styrene, acrylonitrile butadiene styrene, acetal, K resin styrene butadiene copolymers, Nylon 6/6, polyethylene terephthalate, and thermos-plastic elastomers.

It is a least one aspect of the present embodiments to provide a cooler insert that includes a transparent exterior surface, a translucent gel refrigerant, and a plurality of small plastic particles suspended in the gel refrigerant to simulate floating ice particles.

It is still a further aspect of at least one of the present embodiments to provide a cooler insert in which the hexahedrical container has a shape that conforms to the interior of a small cooler.

Additionally, it is still a further aspect of at least one of the embodiments of the present invention to provide a hexahedrical container that is designed and configured to permit one or more hexahedrical containers having one or more beverage containers positioned within the deep beverage receptacles to be vertically stacked upon another hexahedrical container having one or more beverage containers positioned within its deep beverage receptacles.

It is a least once aspect of the present embodiments to provide a cooler insert in which the top side of the exterior surface includes six deep beverage receptacles arranged in two parallel rows of three deep beverage receptacles and the bottom side of the exterior surface includes six shallow beverage receptacles arranged in two parallel rows of three shallow beverage receptacles such that the deep beverage receptacles and the shallow beverage receptacles are coaxially aligned.

It is still a further aspect of at least one of the embodiments of the present invention to provide a cooler in which the hexahedrical container is designed and configured to enclose a plurality of kinds of beverage containers, including but not limited to beer cans, soda cans, water bottles, and milk cartons.

It is a least one aspect of the present embodiments to provide a cooler insert wherein the depth of the deep beverage receptacles on the top side of the exterior surface of the hexahedrical container are equal to the depth of the shallow beverage receptacles on the bottom side of the exterior surface of the hexahedrical container.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
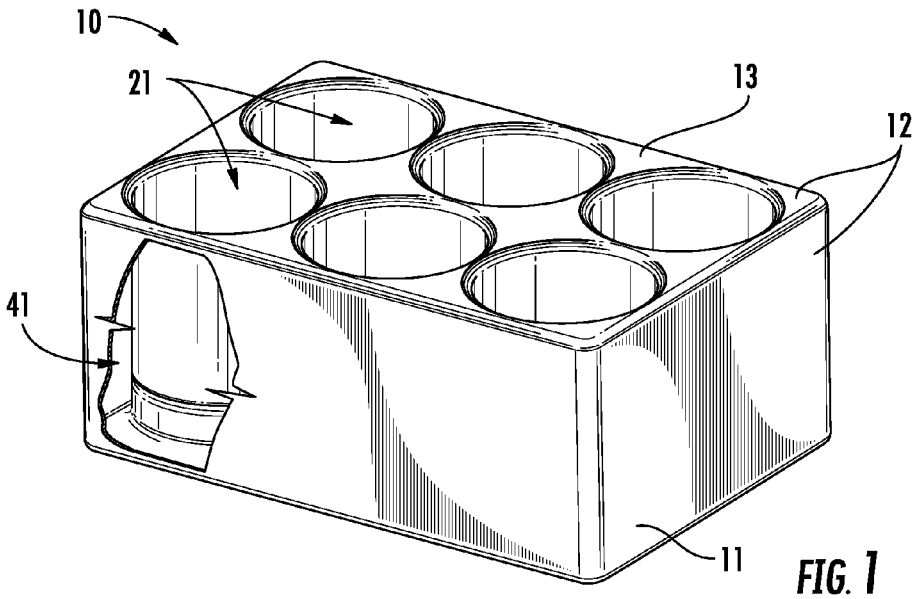
FIG. 1 is a partial cross-sectional perspective view illustrating the top side of a cooler insert.

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention.

In describing the various figures herein, the same reference numbers are used throughout to describe the same material, apparatus, or device item. To avoid redundancy, detailed descriptions of much of the apparatus once described in relation to a figure may not be repeated in the descriptions of subsequent figures, although such apparatus or item is labeled with the same reference numbers.

A cooler insert 10 for cooling beverages or food items is illustrated in FIGS. 1 to 7. In accordance with a preferred embodiment of the present invention, a cooler insert 10 is illustrated in FIGS. 1 to 7 comprising a hexahedrical container 11 which includes a plurality of cylindrical deep beverage receptacles 21 extending from a top side 13 of the hexahedrical container 11 into a hollow interior 41 of the hexahedrical container 11. As used herein, the term "hexahedrical" container is defined and intended as a polyhedron having six sides. The hollow interior 41 of the hexahedrical container 11 contains a refrigerant material 42 to cool a beverage container 51 placed within the deep beverage receptacles 21 or any food items place adjacent to, or in the proximity of, the exterior surface 12 of the hexahedrical container 11. Additionally, the hexahedrical container 11 includes a bottom side 14 with a plurality of shallow beverage receptacles 31 extending upward into the hollow interior 41 of the hexahedrical container 11 to facilitate stacking multiple cooler inserts having one or more beverage containers 51 within the deep beverage receptacles 21, and to provide additional cooling to any beverage containers placed in a lower cooler insert 10.

Figure 2:
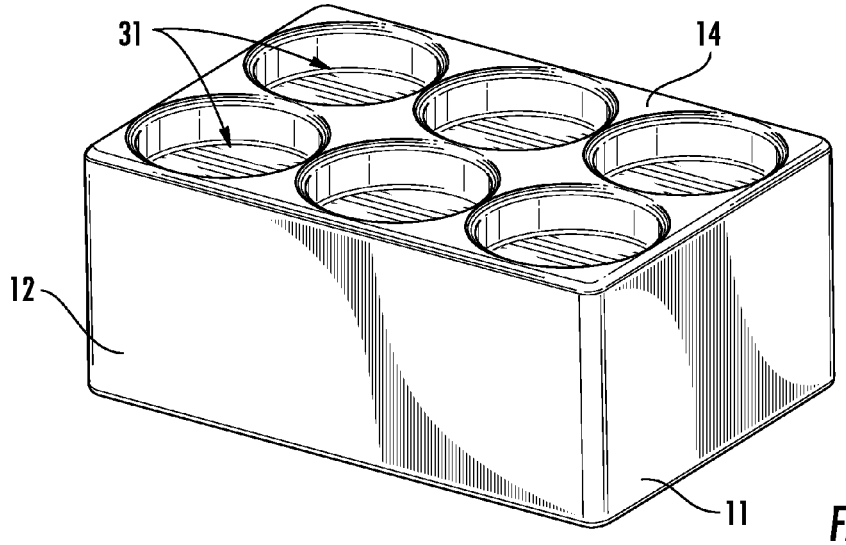
FIG. 2 is a perspective view illustrating the bottom side of a cooler insert.
Figure 3:
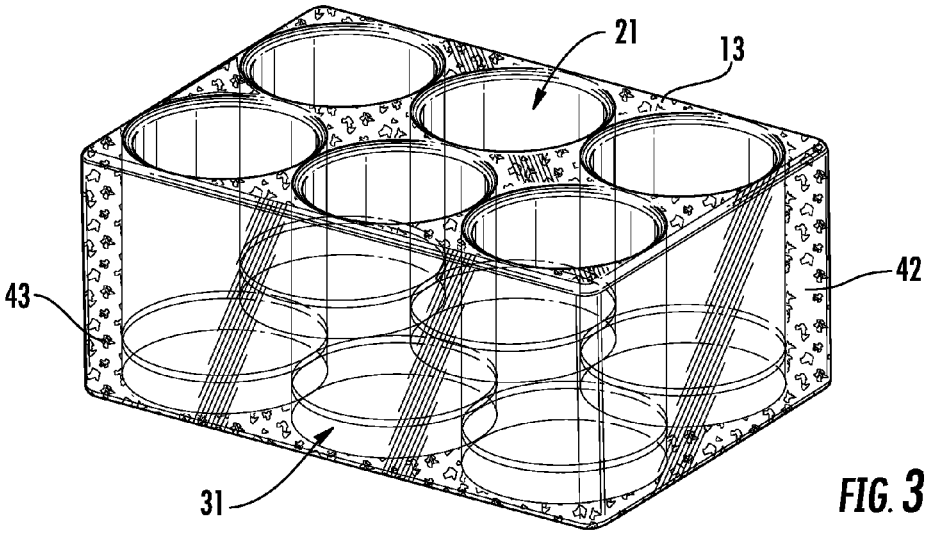
FIG. 3 is a cross-sectional perspective view of a cooler insert.
Figure 4:
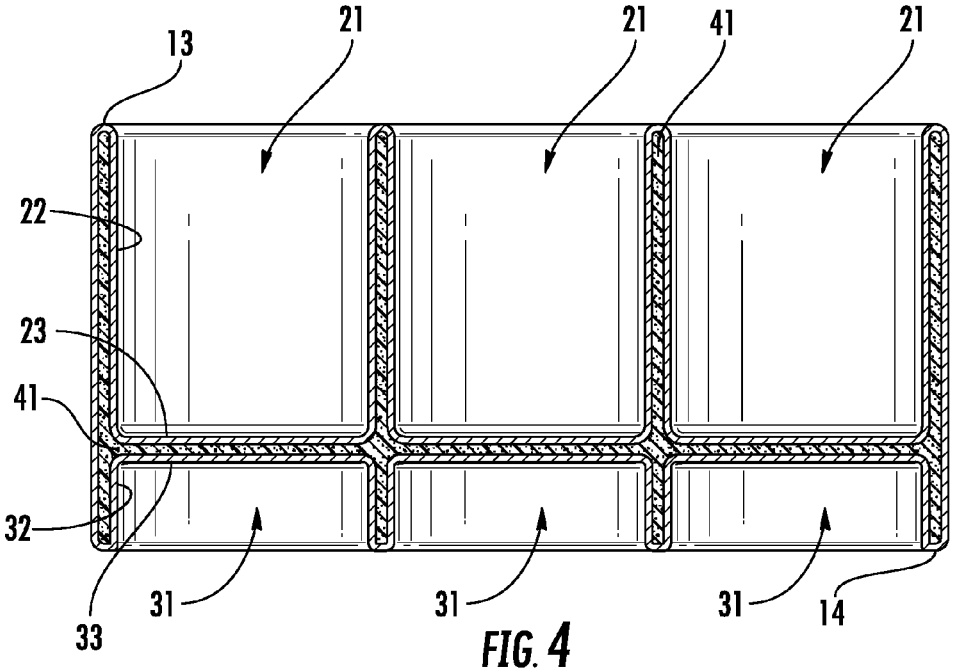
FIG. 4 is a side view cross section of a cooler insert.
Figure 5:
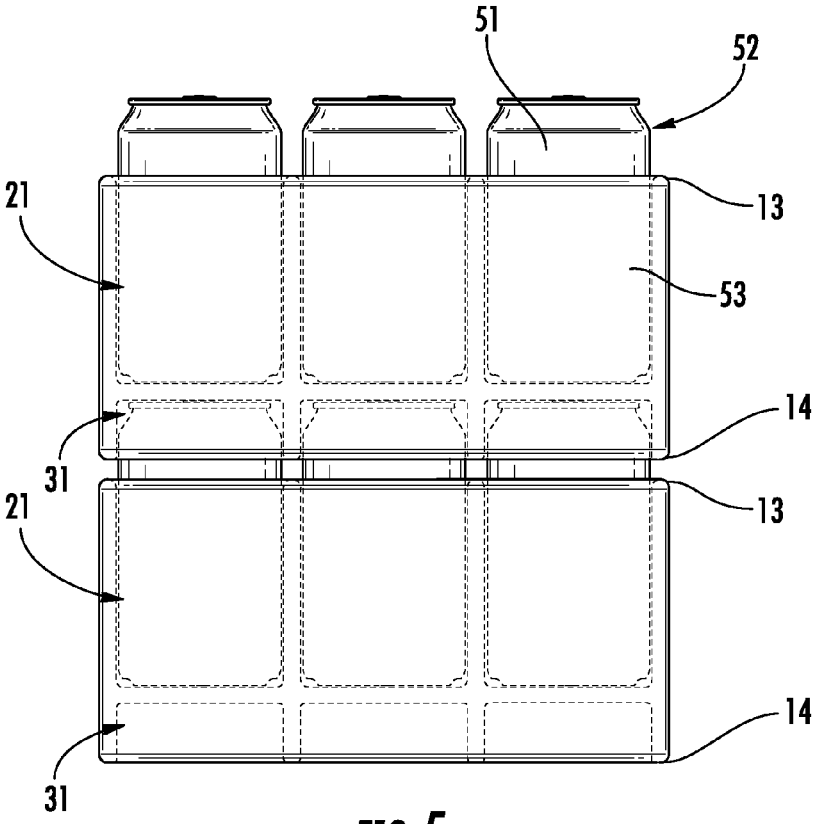
FIG. 5 is a side view cross section of stacked cooler inserts.

Now specifically referring to FIGS. 1, 3, and 4, one embodiment of a cooler insert 10 is shown comprising a hexahedrical container 11 having an exterior surface 12 including a top side 13 and a bottom side 14. Additionally, the hexahedrical container 11 includes a plurality of deep beverage receptacles 21 arranged in a parallel configuration and extend from the top side 13 of the exterior surface 12. Referring to FIG. 4, the deep beverage receptacles 21 also have a cylindrically shaped side 22 which emanates downward to a bottom 23. Now referring to FIGS. 2, 3, and 4, the hexahedrical container 11 also includes a plurality of shallow beverage receptacles 31 extending from the bottom side 14 of the exterior surface 12. Referring to FIG. 4, the shallow beverage receptacles 31 have a cylindrically shaped side 32 emanating upward to a top 33. As shown in FIGS. 3, 4, and 5, the shallow beverage receptacles 31 located on the bottom side 14 of the exterior surface 12 of the hexahedrical container 11 are co-axially aligned with the deep beverage receptacles 21 located on the top side 13 of the exterior surface 12 of the hexahedrical container 11. In similar fashion, the diameters of the deep beverage receptacles 21 and the shallow beverage receptacles 31 are equal in a preferred embodiment of the present invention. Now referring to FIGS. 1 and 4, the hexahedrical container 11 also includes a hollow interior 41 that is configured to provide a fluid-tight reservoir. The hollow interior 41 is surrounded by the exterior surface 12 of the hexahedrical container 11 and the plurality of cylindrically shaped sides 22, 32 of the deep beverage receptacles 21 and the shallow beverage receptacles 31, as well as the bottom 23 of the deep beverage receptacle 21 and the top 33 of the shallow beverage receptacles 31. Additionally, now referring to FIGS. 1 and 3, a refrigerant material is disposed within the hollow interior 41 of the hexahedrical container 11 and therefore enables the cooler insert 10 to cool not only beverage containers within and in communication with the deep beverage receptacles 21 and the shallow beverage receptacles 31, but also others items in direct communication with, or adjacent to, the exterior surface 11 of the cooler insert.

As shown in FIGS. 1, 3, 5, 6, and 7, in one embodiment of the present invention each of the deep beverage receptacles 21 on the top side 13 of the hexahedrical container 11 are designed and configured to enclose a substantial portion of a beverage container body 53 such that most of the beverage container 51 is exposed to the cooling effect of the refrigerant material 42 housed within the hollow interior 41 of the hexahedrical container 11. The beverage container 51 has a top portion 52 that is not enclosed by the deep beverage receptacle 21 which permits easy access to the beverage container for removal from the deep beverage receptacle 21.

A preferred embodiment of the present invention is illustrated in FIGS. 2, 3, 4, and 5, wherein each of the shallow beverage receptacles 31 of the hexahedrical container 11 has a depth sufficient to at least partially enclose the top portion 52 of an inserted beverage container 51 when a first cooler insert is stacked on top of a second cooler insert containing one or more beverage containers 51, wherein the first cooler insert 10 may or may not contain one or more beverage containers.

In a preferred embodiment of the present invention a translucent gel refrigerant material 42 as shown in FIG. 3 is disposed within the hollow interior 41 of the hexahedrical container 11, and is used to cool the beverage container 51 placed within the deep beverage receptacle 21. Non-water, or gel refrigerants, or such other similar refrigerant material possessing the necessary heat or cold retaining properties, can be used in the present invention to keep the content of beverage containers cold.

As illustrated in FIGS. 1 and 2, additional embodiments of the present invention may include an exterior surface 12 for the hexahedrical container 11 which is manufactured from a heat conductive polymer, such as but not limited to, polyethylene, polypropylene, styrene, acrylonitrile butadiene styrene, acetal, K resin styrene butadiene copolymers, Nylon 6/6, polyethylene terephthalate, and thermos-plastic elastomers.

Referring to FIG. 3, a preferred embodiment of the present invention includes a hexahedrical container 11 having a transparent exterior surface and a translucent gel refrigerant material 42 disposed within the hollow interior of the hexahedrical container. A plurality of small clear, or translucent, plastic particles 43 are dispersed and suspended within the translucent gel refrigerant. It is intended that the plastic particles appear as ice crystals floating within the translucent gel refrigerant.

Figure 6:
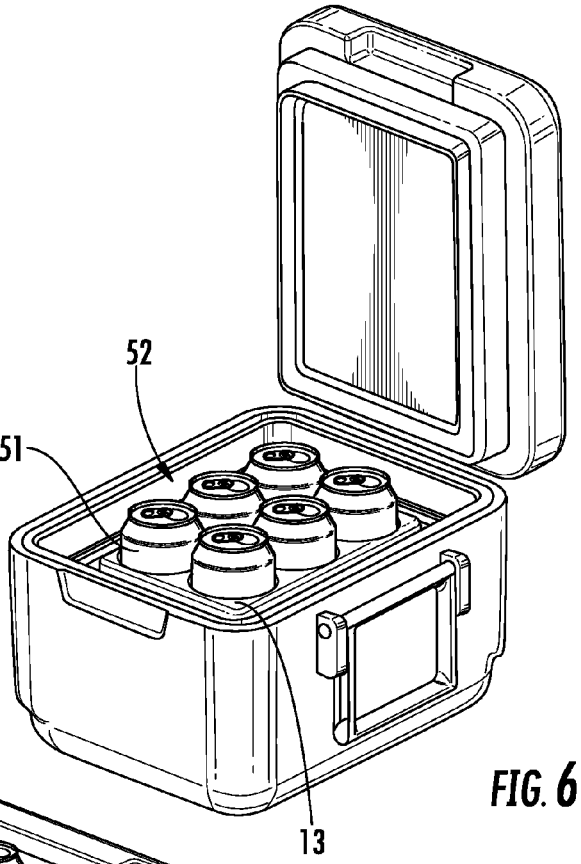
FIG. 6 is a perspective view of a cooler insert within a small cooler.
Figure 7:
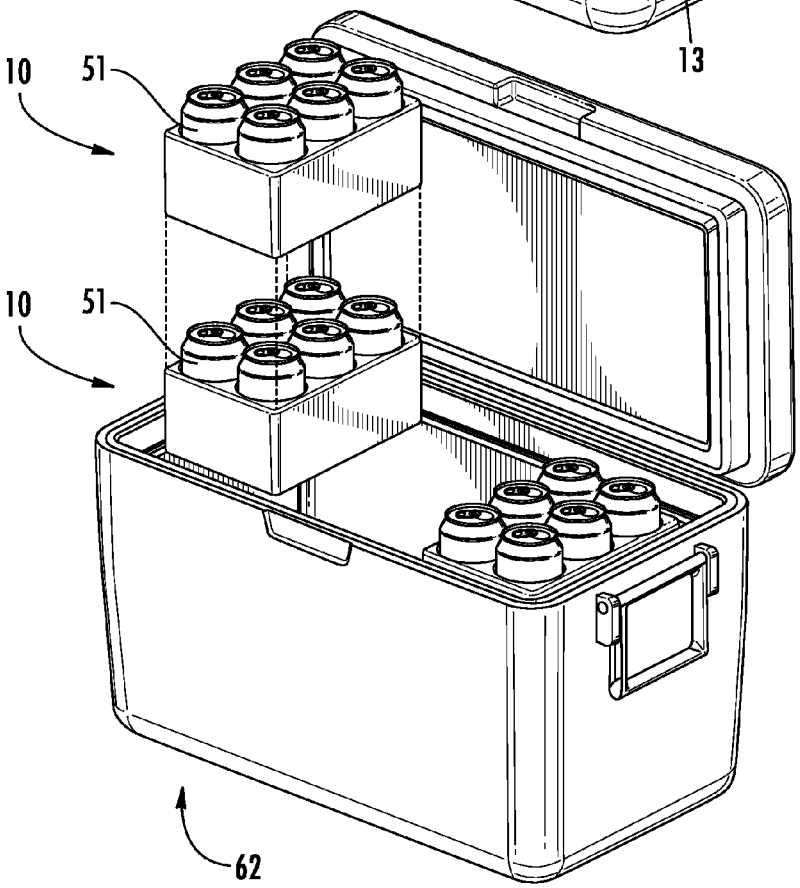
FIG. 7 is a partial exploded perspective view of stacked cooler inserts in a large cooler.

In another embodiment of the present invention, referring to FIG. 6, the hexahedrical container 11 has a shape which conforms to the interior shape of a small cooler 61.

Referring to FIGS. 1 and 2, in still another embodiment of the present invention the configuration of exterior surface 12 includes two parallel rows of three deep beverage receptacles 21 on the top side 13 of the hexahedrical container 11 and two parallel rows of three shallow beverage receptacles 31 on the bottom side 14 of the hexahedrical container 11 with the deep beverage receptacles 21 being co-axially aligned with the shallow beverage receptacles 31. This configuration and packaging for six-pack beverages is often used in the retail sale of six-packs of bottled water, as well as cans of soda, beer, and juice. The bottles and cans for such six-pack beverages can often be placed directly into the cooler insert without the need to first remove the plastic collar used to by the vendors of these beverages for packaging and distribution.

Additional embodiments of the present invention include the hexahedrical container being designed and configured to enclose various of kinds of beverage containers such as beer cans, soda cans, water bottles, juice cans, milk cartons, and other beverage containers. The size, shape, and depth of the deep beverage receptacles on the top side of the cooler insert, as well as the size, shape, and depth of the shallow beverage receptacles on the bottom side of the cooler insert can be configured as needed to accommodate the specific shape and size for different kinds of beverage containers.

An additional embodiment of the present invention includes a hexahedrical container in which the depth of the beverage receptacles located on the top side of the hexahedrical container is the same as the depth for the beverage receptacles located on the bottom of the hexahedrical container. This configuration of the cooler insert eliminates receptacles on a specific side of the cooler insert as being designated to receive either the top portion or the bottom portion of a beverage container. Additionally, the orientation of such an embodiment of a cooler insert is not a factor when stacking multiple cooler inserts with beverage containers on top of one another.

To use the present invention the cooler insert is placed into a freezer, or other cold environment, for at least one hour prior to use to adequately decrease the temperature of the gel refrigerant housed within the hollow interior of the cooler insert. Once gel refrigerant within the cooler insert has had sufficient time to cool or freeze, appropriate sized beverage containers are placed within the deep beverage receptacles until the beverage is removed by the user for consumption of the beverage container contents. A single cooler insert can be use by itself when cooling a small number of beverage containers. Or, multiple cooler inserts can be used when cooling a larger number of beverage containers. When using multiple cooler inserts for larger numbers of beverage containers, the cooler inserts can be stacked on top of each other to maximize cooling efficiency. Additionally, referring to FIG. 6, the single cooler insert can be designed and configured to fit inside a small cooler to maximize cooling efficiency and to facilitate transportation of the cooler insert and its beverage container contents. Likewise, referring to FIG. 7, multiple cooler inserts can be designed and configured to fit inside a large cooler to maximize cooling efficiency and to facilitate transportation of the cooler inserts and their beverage containers.

The previous versions of the present invention have many advantages including the ability for the cooler insert to be used as a single cooler insert, together with multiple cooler inserts if desired or necessary, or alone as a stand-alone cooler. When multiple cooler inserts are used, the design, configuration, and inter-cooperation between the deep beverage receptacles and the shallow beverage receptacles allow for the stable stacking of the cooler inserts. Additionally, when the cooler inserts are used in a stacked configuration, the beverage containers in the lower beverage receptacles receive maximum cooling since very little of the beverage container's surface is not enclosed within a beverage receptacle. Additionally, the cooler insert is environmentally friendly since its refrigerant material is housed within the fluid-tight hexahedrical container that is manufactured from durable materials. As such, there is no need to replace the refrigerant material, nor is there a possibility of pollution as there may be with other systems in which the refrigerant material can be lost, or must be replaced after use, such as certain non-water refrigerants, as well as contaminated ice or water, that may pollute the ground. The cooler insert also requires no, or very little, maintenance due to its design and the materials from which it is manufactured. In the event the cooler insert becomes dirty, it can be easily cleaned and rinsed with water in preparation of its return to use. Therefore, the cooler insert can be used repeated over an indefinite period of time. However, when ice is used as a refrigerant and becomes contaminated with dirt or debris, the ice must be discarded and replaced. When the cooler insert is used in its six-pack configuration, there is no need to remove the plastic packaging ring which is often used in the retail sales and distribution of six-packs of beverages such as soda, beer, and bottled water until a beverage container is removed from the cooler insert. Since the refrigerant material is sealed with the fluid-tight interior of the cooler insert, there is no need to purchase ice or other refrigerant material. The cooler insert is simply placed in freezer or other cold environment for at least one hour prior to use to allow sufficient time for the gel refrigerant to cool or freeze. Additionally, since ice is not used as the refrigerant material, there is no opportunity for leaks or items getting wetting un-necessarily. The cooler insert is also adaptable for use with existing hard-shell coolers of various sizes and kinds, as well as coolers constructed from nylon fabric materials. Unlike traditional coolers, the present invention is free from associated water leaks or fabric tears. Additionally, not only does the cooler insert cool beverage containers within its beverage receptacles, it also provides cooling temperatures to other items that are otherwise adjacent to the cooler insert's exterior surface. The gel refrigerant within the cooler insert's hollow interior that surrounds the cooler insert's beverage receptacles is also in direct communication with exterior surfaces of the cooler insert which in turn provides additional cooling surfaces which can be utilized. The cooler insert can also be designed, configured, and manufactured to accommodate beverage containers having a variety of shapes and sizes.

Although preferred embodiments of the invention have been described using specific terms, devices, and methods, such description if for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, either in whole, or in part. Therefore, the spirit and scope of the invention should not be limited to the description of the preferred versions contained herein.

That which is claimed:

1. A cooler insert comprising:

an enclosed hexahedrical container having an exterior surface including a top side and a bottom side, said exterior surface being devoid and any openings into the interior of said container;

a plurality of deep beverage receptacles arranged in a parallel configuration and extending from the top side of the exterior surface, said deep beverage receptacles having a cylindrically shaped side emanating downward to a bottom;

a plurality of shallow beverage receptacles extending from the bottom side of the exterior surface, said shallow beverage receptacles having a cylindrically shaped side emanating upward to a top, said shallow beverage receptacles being co-axially aligned with the deep beverage receptacles located on the top side of the exterior surface, wherein each of the shallow beverage receptacles has a depth sufficient to receive and at least partially enclose the top portion of a beverage container inserted into the deep beverage receptacle of a lower first cooler insert when an upper second cooler insert is stacked on top of the lower first cooler insert containing one or more beverage containers in the deep beverage receptacles, wherein the upper second cooler insert may or may not contain one or more beverage containers;

a hollow interior surrounded by the exterior surface and the plurality of cylindrically shaped sides, wherein said hollow interior being configured to provide an enclosed fluid-tight reservoir devoid of any openings to the exterior surface of said hexahedrical container; and a refrigerant material disposed and sealed within the hollow interior.

2. The cooler insert of claim 1, wherein each of the deep beverage receptacles on the top side of the hexahedrical container being designed and configured to enclose a substantial portion of a beverage container, said beverage container having a top portion and a body portion, the top portion of the beverage container extending a distance from the deep beverage receptacle sufficient for grasping and removing said beverage container from said deep beverage receptacle.

3. The cooler insert of claim 1, wherein the refrigerant material includes, but is not limited to a gel refrigerant.

4. The cooler insert of claim 1, wherein the exterior surface being made from a heat conductive polymer comprising polyethylene, polypropylene, styrene, acrylonitrile butadiene styrene, acetal, K resin styrene butadiene copolymers, Nylon 6/6, polyethylene terephthalate, and thermoplastic elastomers.

5. The cooler insert of claim 1, wherein said exterior surface is transparent.

6. The cooler insert of claim 1, wherein the hexahedrical container comprising a shape which conforms to the interior of a small cooler.

7. The cooler insert of claim 1, wherein said hexahedrical container is designed and configured to permit one or more hexahedrical containers to be vertically stacked upon another hexahedrical container when said hexahedrical containers contain one or more beverage containers.

8. A cooler insert comprising:

an enclosed hexahedrical container having an exterior surface including a top side and a bottom side, said exterior surface being devoid and any openings into the interior of said container;

a plurality of deep beverage receptacles arranged in a parallel configuration and extending from the top side of the exterior surface, said deep beverage receptacles having a cylindrically shaped side emanating downward to a bottom;

a plurality of shallow beverage receptacles extending from the bottom side of the exterior surface, said shallow beverage receptacles having a cylindrically shaped side emanating upward to a top, said shallow beverage receptacles being co-axially aligned with the deep beverage receptacles located on the top side of the exterior surface, wherein each of the shallow beverage receptacles having a depth sufficient to receive and at least partially enclose the top portion of a beverage container inserted into the deep beverage receptacle of a lower first cooler insert when an upper second cooler insert is stacked on top of the lower first cooler insert containing one or more beverage containers in the deep beverage receptacles, wherein the upper second cooler insert may or may not contain one or more beverage containers;

a hollow interior surrounded by the exterior surface and the plurality of cylindrically shaped sides, wherein said hollow interior being configured to provide an enclosed fluid-tight reservoir devoid of any openings to the exterior surface of said hexahedrical container; and a refrigerant material disposed and sealed within the hollow interior, said refrigerant material includes, but is not limited to a clear gel refrigerant.

9. The cooler insert of claim 8, wherein each of the deep beverage receptacles on the top side of the hexahedrical container being designed and configured to enclose a substantial portion of a beverage container, said beverage container having a top portion and a body portion, the top portion of the beverage container extending a distance from the deep beverage receptacle sufficient for grasping and removing said beverage container from said deep beverage receptacle.

10. The cooler insert of claim 8, wherein the exterior surface being made from a heat conductive polymer.

11. The cooler insert of claim 8, wherein said exterior surface is transparent.

12. The cooler insert of claim 8, wherein said clear gel refrigerant includes a plurality of suspended clear plastic particles.

13. The cooler insert of claim 8, wherein the hexahedrical container comprising a shape which conforms to the interior of a small cooler.

14. The cooler insert of claim 8, wherein said hexahedrical container is designed and configured to permit one or more hexahedrical containers to be vertically stacked upon another hexahedrical container when said hexahedrical containers contain one or more beverage containers.

15. The cooler insert of claim 8, wherein the exterior surface includes six deep beverage receptacles and six shallow beverage receptacles.

16. The cooler insert of claim 8, wherein said hexahedrical container is designed and configured to enclose a plurality of kinds of beverage containers, including but not limited to beer cans, soda cans, water bottles, and milk cartons.

17. The cooler insert of claim 8, wherein the depth of the deep beverage receptacles on the top side of the hexahedrical container are equal to the depth of the shallow beverage receptacles on the bottom side of the hexahedrical container.

* * * * *